169-46
1/24/84 OR 4,427,074

United States Patent [19]

Wollin

[11] 4,427,074

[45] Jan. 24, 1984

[54] SPRAYING APPARATUS

[76] Inventor: Goesta Wollin, Snedens Landing, Palisades, N.Y. 10964

[21] Appl. No.: 266,281

[22] Filed: May 22, 1981

[51] Int. Cl.[3] ..... A62C 1/00

[52] U.S. Cl. ..... 169/46; 169/70; 239/383

[58] Field of Search ..... 169/14, 43, 46, 47, 169/54, 70, 91; 239/240, 239, 380, 381, 382, 383; 92/12.2, 57, 71, 157; 91/402; 222/318

[56] References Cited

U.S. PATENT DOCUMENTS

| | | | |
|---|---|---|---|
| 1,055,411 | 3/1913 | McWilliams et al. | 239/382 |
| 1,591,401 | 7/1926 | Palmer | 169/15 |
| 1,996,884 | 4/1935 | Schellin | 239/383 |
| 2,202,754 | 5/1940 | Caddy | 92/157 |
| 2,276,961 | 3/1942 | Graham et al. | 239/214.13 |
| 2,361,046 | 10/1944 | Holly | 92/57 |
| 2,434,771 | 1/1948 | Mueller et al. | 222/318 |
| 2,968,442 | 1/1961 | Grabski | 239/383 |
| 3,607,779 | 9/1971 | King et al. | 169/14 |
| 3,610,527 | 10/1971 | Ericson et al. | 239/25 |
| 3,780,812 | 12/1973 | Lambert | 169/15 |
| 4,090,430 | 5/1978 | Matsumoto et al. | 92/168 |
| 4,364,307 | 12/1982 | Paro | 92/157 |

*Primary Examiner*—Joseph J. Rolla
*Assistant Examiner*—Charles C. Compton
*Attorney, Agent, or Firm*—Kenyon & Kenyon

[57] ABSTRACT

An impeller is connected to a liquid-powered motor to be driven thereby. The impeller is of a type capable of moving a large volume of air of the order of as much as several thousand cubic meters per minute, which is ten or more times the volume of liquid used to power the motor. Some or all of the liquid applied to the motor to be transformed into mechanical energy is carried by a conduit to a point where it can suitably enter the air stream provided by the impeller. The conduit can carry the liquid to a point between the motor and the impeller so as to be picked up along with air and included in the stream forcibly projected from the impeller. Alternatively, the conduit can be routed around the impeller to discharge the liquid into the already formed air stream. The conduit for the liquid can be arranged to receive only liquid that has been used to supply power to the motor, or it can be provided with an additional inlet to receive one or more additional chemicals to improve the nature of the aerosol, which is the combined air and finely divided water particles propelled by the impeller.

29 Claims, 8 Drawing Figures

SPRAYING APPARATUS

BACKGROUND OF THE INVENTION

1. Field of the Invention

This invention relates to the field of liquid spraying apparatus and particularly to apparatus that uses a liquid-actuated motor to drive an impeller that produces a stream of air in which at least some of the same liquid supplied to the apparatus to actuate the motor is entrained in the form of finely divided particles to be driven by the air stream.

2. Prior Art

In recent years the structures of buildings and the furniture and artifacts in them have increasingly been made of polymers in place of the materials formerly used. For example, plastic outer walls are now sometimes used instead of wooden walls; plastic pipe is now used instead of some of the metal pipe that was formerly used in plumbing; some items of furniture that used to be made of wood are now made of plastic; artificial fibers are used in carpets, drapes, and clothing in place of wool and cotton; and plastic wall coatings are used in place of wallpaper. These and other plastic materials have, in differing degrees, advantages of cost, looks, ease of installation, and some other characteristics not even attainable by materials more nearly in the form in which they occur in nature. However, plastic or polymeric material frequently is seriously inferior to natural materials in the event of fire.

One of the most significant disadvantages of some plastics during combustion is that many of them release a much larger amount of smoke and highly poisonous, invisible gases than do the more traditional materials. There are, for example, polymers that produce 500 times as much smoke per pound as is produced by wood, and the poisonous gases produced by some polymers can arrest, within a few seconds, the breathing of anyone who inhales such gases and smoke.

Another serious problem is that some combusting polymers release heat 100 times as fast as wood and burn at a higher temperature than wood. This not only means that other combustible materials, whether polymers or natural materials, in the vicinity may be raised to the ignition point much more quickly than in the case of a fire fueled by burning wood, but that the fires tend to travel more rapidly. In effect, the fires flash from one point to others, and the flashing has even been known to take place between buildings separated by a thoroughfare.

Fighting such fire by streams of water from hoses, even under high pressure, is inefficient. The water does little or nothing to control the flow of smoke and poisonous gases or to limit the flashing. When the water hits a piece of burning material, the water can drown the fire by preventing further oxygen from reaching that point, and the heat in the burning object can be absorbed by raising the temperature of the water, but all of this may have no effect on other burning objects quite close to the one being struck by the stream of water. As a result, large amounts of water are used in putting out a fire, and the water damage is likely to be a significant part of the total destruction.

Fire fighters have tried using fogging devices to envelope the burning area in a fog of atomized water particles, but such fogging devices produce a force of reaction that tends to make them difficult to manage, and very dangerous to fire fighters if those who are using such devices lose hold of them. One reason that fogging devices as used heretofore have presented a special problem is that they required higher pressure to produce the fog than simply to allow the stream of water to emerge from the fire hose without change. When water emerges from the nozzle of a hose, it produces a force of reaction equal to the pressure times the outlet area of the nozzle. These factors must be kept in mind in designing a hose and nozzle and in supplying pressurized water so that the total reaction force can be managed, preferably by one fireman, if the hose is to be hand-carried. For example, if the reaction force is not to exceed about 13.5 Kg and the effective size of the output aperture of the nozzle is about 13.5 $cm^2$, the water pressure in a hose must be limited to about 10,000 $Kg/cm^2$, which limits the throw of water from the hose and is much smaller than the normally available water pressure. A fogging nozzle may require about twice that much pressure and thus produce about 27 Kg of reaction force, which is equal to approximately one-third of the weight of a fireman. However, the use of fog is desirable in order to blanket a burning area.

Several types of apparatus have been proposed to break up the stream of water into finely divided particles or fog or to produce a foam that, like the fog, is also capable of blanketing an area. One fog-producing nozzle is shown in U.S. Pat. No. 1,996,884 in which water from a hose is directed, by means of a divided nozzle, at opposite angles against blades projecting from a rotatable disk toward the angled nozzles. Water from the angled nozzles rotates the disk and is broken up into finely divided particles that emerge in a wide angled spray of fog from the outer end of the structure. A good deal of the force or the water is absorbed by the internal walls of the structure, which not only produces a substantial reaction force but also reduces the distance that the fog would be likely to be carried.

U.S. Pat. No. 2,968,442 describes a turbine type nozzle in which a stream of water is directed against a small propeller confined within a hollow cylinder. The water drives the propeller which, in turn, drives an electric generator. A variable resistor is connected to the generator to serve as a blade to control the speed of rotation of the propeller by loading down the generator. The water is, to some extent, broken up by striking the blades of the propeller, but the propeller does not serve to carry the water or spray along, but rather to diminish its forward movement.

U.S. Pat. No. 3,780,812 describes a structure for forming foam in front of a propeller driven by a reaction jet water powered motor. Water and a foaming agent are sprayed against a perforated member that covers the area through which a stream of air from the fan must pass. Not only is the reaction propulsion motor very inefficient, but the perforated member further slows down the stream of air, although it is necessary to have that member in the patented structure.

Other forms of blower arrangements are used to enhance the flow of oil in oil burners. One such device is shown in U.S. Pat. No. 1,055,411 in which fuel oil and air or steam under pressure are directed through a turbine and an annular channel to a diffuser at the end of the channel. The purpose of the diffuser is to assure that the oil and air are thoroughly mixed and to confine the flame to a desired region of combustion. However, it is not proposed to have the diffuser develop a stream of air of large volume per minute that would carry the liquid particles along with it, since the air only reaches the diffuser along the same constricted path as the liquid.

U.S. Pat. No. 2,276,961 also shows a reaction propulsion device which, in this instance, is used in an oil burner and is rotated by the oil emerging through reaction apertures. This structure turns a propeller that is located in the air path to help move the air along. However, the propeller cannot turn any faster than the reactive propulsion device permits. This limits its efficiency in providing a stream of air to carry particles of the fuel along.

U.S. Pat. No. 3,610,527 and its divisional U.S. Pat. No. 3,767,324 describe an atomization structure for atomizing a stream of water and entraining the atomized water in an air stream provided by a propeller mounted to rotate concentrically with and in front of the stream of water. The propeller is rotated by an electric motor, and one of the main uses of the apparatus is to make snow artificially when the temperature is low enough. The water is separated into small streams directed at the blades of the propeller to travel along the blades after striking them and fly off at the trailing edges, where they are dispersed as finely divided particles. Since the propeller blades are not driven by the water, itself, but are driven by a separate electric motor, the stream of air that they produce assists in carrying the finely divided particles a considerable distance. While this structure is suitable for making snow and for other purposes where electric power is available and where the device can be left relatively unattended, it is not suitable for use in the absence of electric power and in close proximity to people who might be injured by the swirling propeller.

It is one of the objects of the present invention to provide spraying apparatus that includes a liquid-powered motor to turn an impeller to blow a stream of air, with the same liquid that is applied to drive the motor being introduced to the stream of air to be moved along by the stream.

Another object is to provide spraying apparatus using a liquid-powered motor that utilizes the energy in pressurized water and is powerful enough to generate the necessary mechanical force to rotate an impeller capable of driving a powerful stream of air but is light enough and with small enough reaction forces to be held-hand and operated by one person.

Still another object is to provide impeller means driven by a liquid-powered motor capable of pressurizing a substantial part of a building to drive fire and combustion products along a desired path.

Still another object is to provide fire fighting apparatus in the form of a liquid-powered motor driving a fan that propels a large, fast moving stream of air in which finely divided particles of the same liquid used to power the motor are entrained from a conduit that carries the liquid to a point either behind or in front of the fan.

Still another object is to provide a liquid-powered motor to drive an impeller and to control the volume of liquid diverted from the motor to the air stream of the impeller.

A further object of the invention is to provide apparatus for spraying divided water particles a distance of approximately 15–25 meters at a rate of approximately 40 liters per minute.

Another object is to provide a positive-displacement motor suitable to be operated by pressurized water, such as from a fire hose.

Further objects will be apparent from the following specification together with the accompanying drawings.

SUMMARY OF THE INVENTION

In accordance with the present invention an impeller is connected to a liquid-powered motor to be driven thereby. The impeller is of a type capable of moving a large volume of air of the order of as much as several thousand cubic meters per minute, which is ten or more times the volume of liquid used to power the motor. Some or all of the liquid applied to the motor to be transformed into mechanical energy is carried by a conduit to a point where it can suitably enter the air stream provided by the impeller. The conduit can carry the liquid to a point between the motor and the impeller so as to be picked up along with air and included in the stream forcibly projected from the impeller. Alternatively, the conduit can be routed around the impeller to discharge the liquid into the already formed air stream.

An especially efficient form of liquid-powered motor is of the type sold by Volvo of America Corp., Hydraulics Division, under their designation of Series F11. This is a multi-cylinder, positive-displacement type motor and has an efficiency in excess of 90–95%. In accordance with this invention, modifications may be introduced in the motor to make it suitable for operation using pressurized water as the source of power.

The apparatus of this invention also includes a guard structure to prevent anyone using it from inadvertently coming into contact with the rapidly rotating impeller. Part of this guard structure includes a duct closely surrounding the tips of the blades of the impeller, a grill between the motor and the impeller, and generally spiral shaped straps on the opposite side of the impeller from the motor.

The conduit for the liquid can be arranged to receive only liquid that has been used to supply power to the motor, or it can be provided with additional inlet means to receive one or more additional chemicals to improve the nature of the aerosol, which is the combined air and finely divided water particles propelled by the impeller.

DETAILED DESCRIPTION OF THE INVENTION

Figure 1:
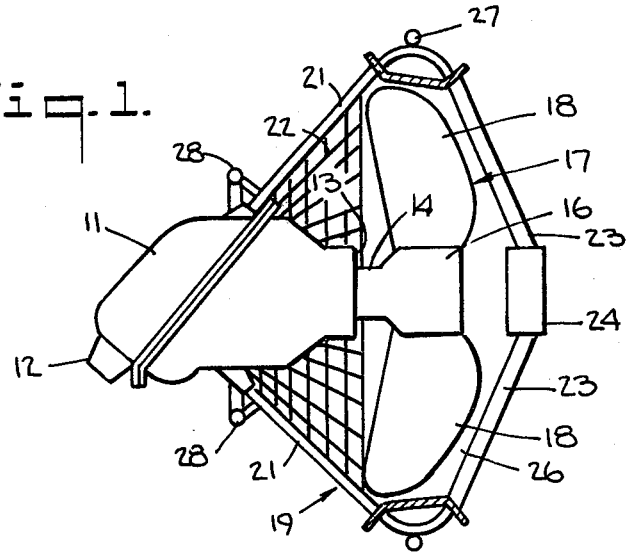
FIG. 1 is a side view, partially in cross-section, of spraying apparatus according to this invention.

FIG. 1 shows one embodiment of the spraying apparatus of this invention especially suited for use in fighting fires. The apparatus includes a liquid-powered motor 11 that has an intake port 12 suitable for connection to a fire hose. At the other end of the motor is an annular outlet port 13 that surrounds an axle 14 to which a hub 16 is attached. The hub is the central part of an impeller 17 that also includes fan blades 18, which extend substantially radially from the hub.

The impeller 17 is enclosed within a guard 19 comprising a tubular frame 21, a grill 22 on the side of the impeller 17 toward the motor 11, and a set of straps 23 on the other side of the impeller, which may be referred to as the output side, since the apparatus is arranged so that, in operation, the impeller 17 will blow a stream of air away from the motor 11 and toward the right in FIG. 1. The straps 23 are attached to a central member 24 and extend out to a duct 26, to which the straps are also attached. The duct 26 is also attached to main tubular members of the frame 21 supported by the motor 11 and an encircling tubular member 27. The cross-sectional shape of the duct, as shown, comes very close to the tips of the blades 18 and is arranged to control the air flow to create a desired air stream when the impeller 17 is rotated by the motor 11.

The structure in FIG. 1 may be mounted in a relatively fixed manner, but it is also provided with hand holds 28, which may comprise a circular tubular member rigidly attached to the frame members 21.

Figure 2:
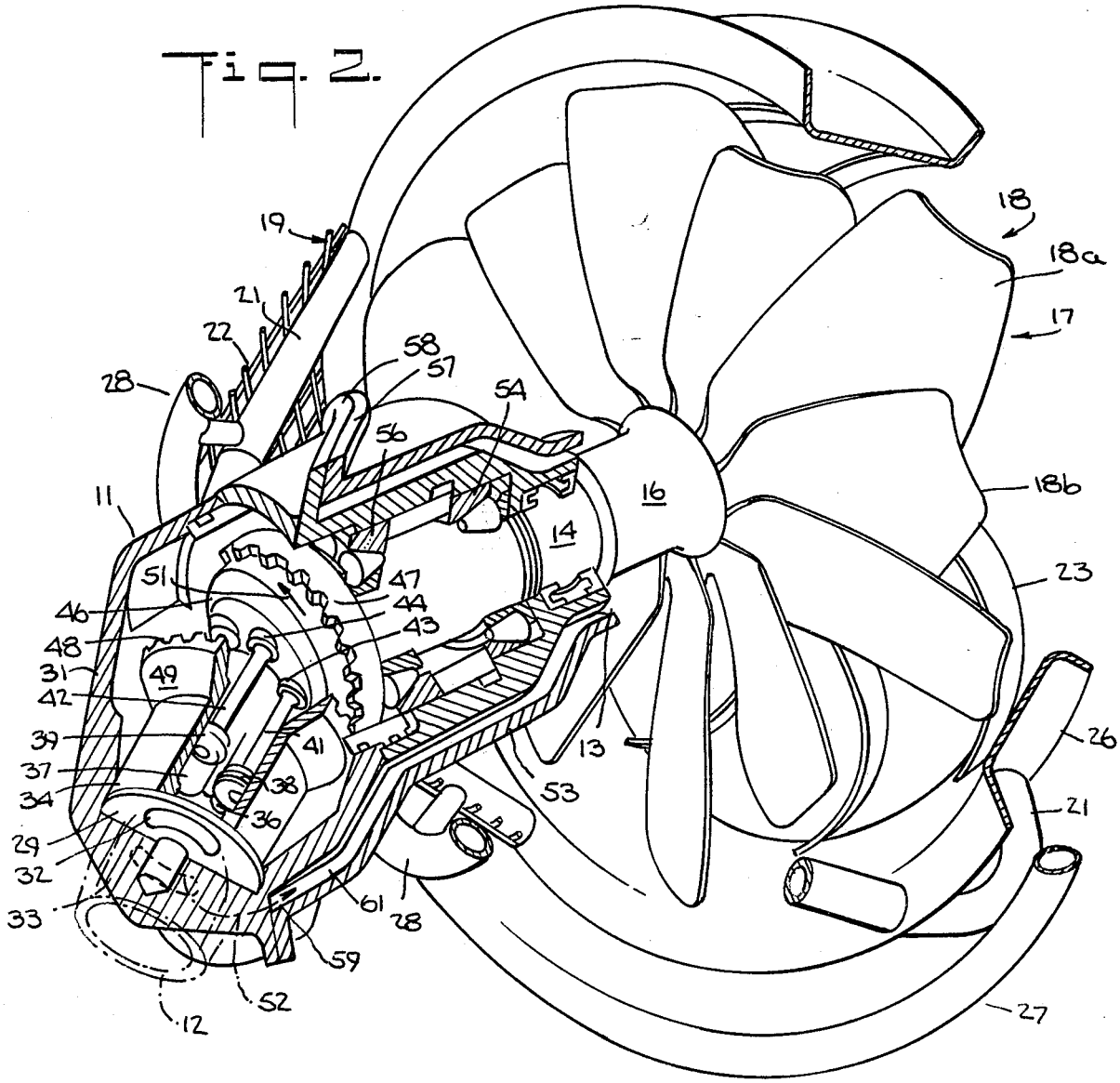
FIG. 2 is a partially fragmented, isometric view of the apparatus in FIG. 1 with some of the parts broken away to show interior constructional features.

FIG. 2 shows the apparatus of FIG. 1 with parts of the structure cut away to show the internal mechanism. The intake port means 12, in this embodiment, is connected to a fixed port plate 29 at one end of the housing 31 of the motor 11. This port plate has two kidney-shaped apertures 32 and 33 through it. The aperture 32 allows high pressure water to enter a cylinder block 34 at the proper point to direct high pressure water into some of the cylinders 36 and 37. Typically, the block 34 may have six cylinders, each with a specifically shaped piston of which only the pistons 38 and 39 are shown. These pistons have side walls that are portions of spheres rather than cylinders, as is usually the case in apparatus that uses pistons. There spherically-shaped pistons are the same pistons used in the Volvo Series F11 hydraulic pumps and motors, and each piston is rigidly attached to a connecting rod, of which only the rods 41 and 42 are shown in FIG. 2.

At the other end of the rods 41 and 42 from the pistons 38 and 39 are spherical big ends 43 and 44 that fit in spherical recesses in a swash plate 46. The swash plate has an axis that makes an angle of about 40° with respect to the axis of the cylinder block 34, which makes it possible to provide long strokes for the pistons in the cylinder block 34. A first bevel gear 47 formed on, or rigidly attached to, the swash plate 46 engages a second bevel gear 48 that extends from a skirt 49 at one end of the cylinder block 34.

The operation of this part of the mechanism is based on the fact that, when liquid under pressure enters the port 32, it presses on the pistons 38 and 39 and pushes them toward the other end of the cylinders 36 and 37. In doing so, force is transmitted through the connecting rods 41 and 42 to the swash plate 46 to cause it to rotate in the direction of the arrow 51. At the same time, two other pistons, which are not visible, on the other side of the cylinder block 34, are being moved toward the plate 29, which causes them to push liquid out of the low-pressure exhaust means 33 along a connection 52 to a space outside of the motor housing 31 and enclosed by a shell 53. The space forms conduit means carry water away from the cylinder block 34.

The meshed bevel gears 47 and 48 cause the cylinder block 34 to rotate in synchronism with the swash plate 46 so that the pistons remain properly aligned with the cylinders. Thus, the pistons 38 and 39 can easily move up and down in the cylinders 36 and 37 without having the angle of the connecting rods 41 and 42 vary more than a few degrees with respect to the cylinders 36 and 37. The swash plate 46 and gear 47 are directly connected to, or are formed on, the end of the output shaft 14. This shaft runs in a bearing structure that comprises sets of tapered bearings 54 and 56.

The shell 53 has a flange 57 that conforms to a flange 58 on the housing 31. It is convenient to have these flanges extend obliquely across the motor 11 so that the low pressure liquid from the port 33 can enter inlet means 59 at the end of the conduit means 61 adjacent the intake port 12. The conduit is so arranged as to be an annular passage at the outlet end 13 adjacent the impeller 17 to permit an annular stream of liquid to be directed into the impeller adjacent the hub 16.

As shown in FIG. 2, the impeller 17 in this embodiment is a fan that includes two sets of blades 18. The blades **18*a* of one of these sets are longer than the blades 18*b* of the other set, and it is the blades 18*a* that extend closest to the duct 26. In this embodiment, there are six blades in each set, and the blades in both sets are wide enough to overlap to a considerable extent so that there is no direct passage that would permit liquid from the outlet 13 to pass axially through the impeller 17 without striking one or more of the blades 18. The tips of the blades 18*a* are preferably of a length such that they trace out a circle of about 46–56 cm diameter. The blades 18*b* are shorter and trace out a circle of somewhat smaller diameter, typically about 5.7 cm smaller, than the diameter of the circle traced out by the tips of the blades 18*a* of the same impeller. Therefore, the radial dimension of the blades 18*b* is chosen so as to correspond to the particular size of the blades 18*a*** used in a given impeller.

The impeller or fan, 17 can be made of sheet metal, but it is preferable to cast or mold it to obtain optimum air flow conditions. For example, in order to improve the turbulence that creates the aerosol, it is desirable that each of the blades 18 have minimum thickness at a point in the central region of the blade and increase toward the trailing edge.

It is important that the protective structure around the impeller 17 not interfere too much with the air flow, and it is for that reason that the straps 23 are spiral-shaped and curve in the opposite direction from the direction if rotation of the impeller 17 and intersect the duct 26 at an acute angle.

In fighting a fire, particularly one containing the combustion products of burning plastic material, it is most desirable to be able to move a sufficient quantity of air to create a pressurized space within the building where the fire is located. The purpose is to drive the smoke and gases, and to some extent the heat, away from one part of the building to another part where they can either be contained or safely vented. In order to do this it is necessary that the impeller 17 be capable of moving a sufficient quantity of air, preferably 1000 cubic meters per minute or more. To do this efficiently, the motor 11 is arranged to rotate the impeller 17 about 3000–4000 rpm, and the blades 18 are so shaped and tilted as to be able to move several thousand cubic meters per minute when rotated at speeds within that range.

When the intake port 12 is connected to a fire hose to receive the pressurized water to operate the motor 11 and to provide liquid to be atomized, or divided into fine particles, by the impeller 17 acting as an axial atomizer, the apparatus can receive about 400–600 liters per minute at a pressure of up to about 100,000 $Kg/m^2$. One of the advantages of the present invention when used in fire fighting apparatus is that a motor of the type illustrated in FIG. 2 can produce a power output of about 13 horsepower when connected to a fire hose capable of supplying water in the manner just described, and yet the pressure of the water is so reduced by being changed into mechnical force to rotate the impeller 17 that the apparatus can be held by one person. The resulting mixture of finely divided water particles and air, which combination is appropriately referred to as an aerosol, can extend a distance of about 25–40 meters from the impeller 17 and can include all of the water that has been used in powering the motor 11 sufficiently to produce an output of about 13–15 bhp at 3600 rpm. It is one of the advantages of the type of motor 11 shown in FIG. 2 that it can be relatively light, approximately 16 Kg, or about 1 Kg per horsepower.

The aerosol typically expands outwardly from the center of the impeller within an included angle of about 30°–45°, which makes it reasonably confined but still broad enough to quench a large area of burning material rather than the smaller area that would be quenched by a stream of water not broken up into finely divided particles and formed into an aerosol. The quantity of air required to produce an aerosol cloud of this magnitude is sufficient to pressurize a large space within a building where the fire is located. This fact plus the ability of the aerosol to flow around corners greatly increases the ability of the spraying apparatus of this invention to fight fires as compared with regular, high pressure hoses.

By having the water component in the form of finely divided, or atomized, particles, the aerosol is able to absorb a great deal of heat due to the fact that the particles can easily be changed to vapor. This takes advantage of the fact that the heat of vaporization is about 544 cal./gram, whereas raising the temperature of a gram of water 1° C., if the temperature is below the vaporization level, only absorbs one calorie.

Figure 3:
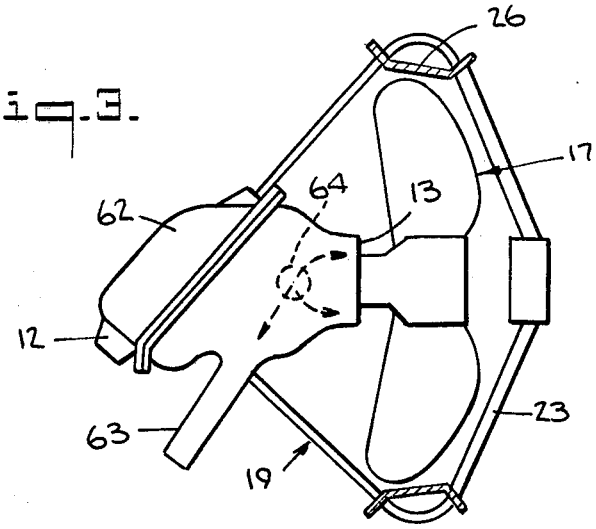
FIG. 3 shows a plan view of a modified embodiment in which only part of the water used to power the motor is directed into the impeller.

FIG. 3 shows a modified embodiment of the apparatus in FIGS. 1 and 2. In FIG. 3, a motor 62 similar to the motor 11 in FIG. 2 has an intake 12 to be connected to a source of pressurized liquid such as a fire hose. However, the motor 62 has an outlet 63 connected to a liquid disposal bind, and it has a valve 64 in the low pressure part of the liquid conduit while within the outer shell of the motor. The valve 64 is controllable to direct part of the low pressure water to the outlet 63 and the remainder of it to the outlet 13 to be fed into the impeller 17.

The structure in FIG. 3 makes it possible to reduce the water content in the aerosol while still maintaining as high a velocity of the air stream as the motor 62 and the impeller 17 are capable of creating. Furthermore, this embodiment has the advantage that the excess water to be disposed of in the return line is at low pressure, having been used to power the motor 62. In the case of firefighting apparatus, the return line can simply be another fire hose connected to drain the water outside of the burning structure or at some convenient location.

Figure 4:
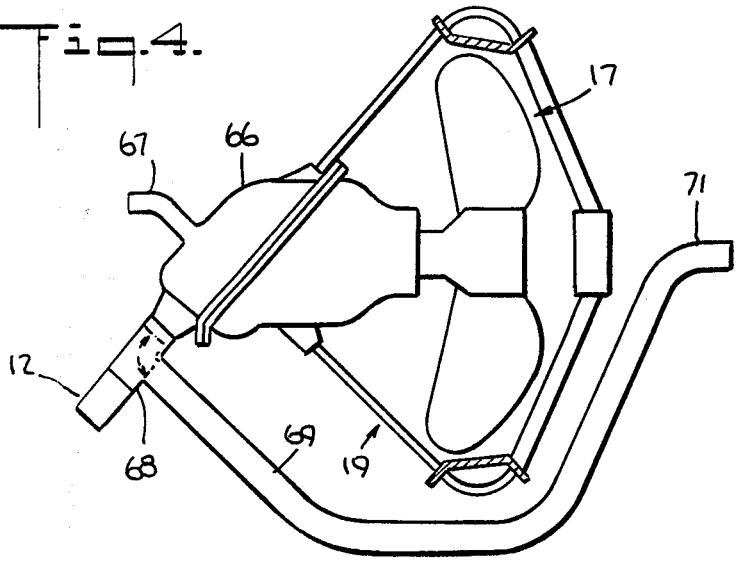
FIG. 4 is a plan view of another modification in which part of the water supplied to the spraying apparatus is carried to a point within the stream of air produced by the impeller and is released there.

FIG. 4 shows a further modified embodiment having a motor 66 of the same type as the motor 11 in FIG. 2 except that it is provided with a separate outlet 67 through which liquid that has been used to power the motor is sent to be disposed of. At the intake port 12 of the motor 66 is a valve 68 connected to the motor 66 and to the inlet of a separate conduit 69. This conduit extends around the motor 66 and the guard structure 19 and has a discharge end 71 on the axis of the impeller 17. The liquid is discharged through the discharge end 71 as a stream of water and does not pass through the impeller 17 to be atomized therein. However, the stream is carried along by the air stream from the impeller. Furthermore, the motor 66 may include an outlet similar to the outlet 13 in FIG. 2 to direct some of the low pressure water into the impeller 17 to create an aerosol having a lower water content than in the embodiment of in FIG. 2 but having the advantage of a stream of water from the discharge end 71 included within the aerosol cloud.

Figure 5:
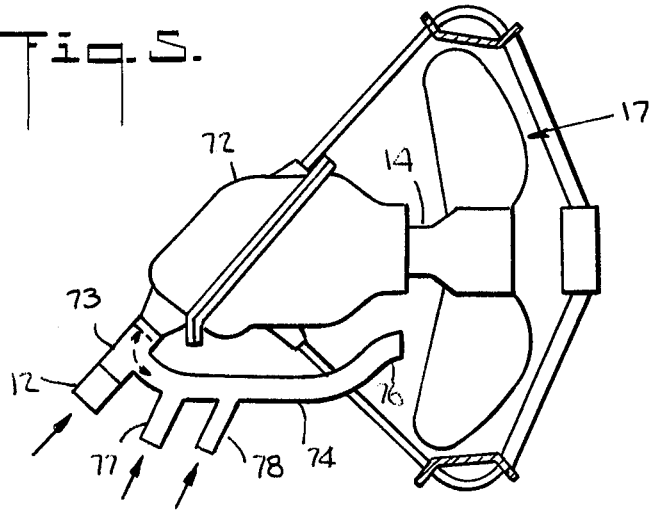
FIG. 5 is a plan view of a further modified embodiment in which part of the water received at high pressure is directed around the motor and into the impeller.

FIG. 5 shows a further embodiment including a motor 72 similar to the motor 11 in FIG. 2. A valve 73 is connected to the intake port 12 to control the percentage of liquid allowed to go to the motor 72 and directing the remainder of the liquid received through the intake port to the inlet of a conduit 74 that has a discharge end 76 on the intake side of the impeller 17. This conduit, which may be made concentric with the axle 14 of the impeller 17, discharges high pressure liquid into the impeller.

Furthermore, the conduit 74 has additional intake ports 77 and 78 to receive additional chemicals, such as fogging agents to be mixed with the liquid, which is typically high pressure water, in the conduit 74. Since this conduit bypasses the motor 72, the chemicals added by way of the intakes 77 and 78 may be of the type that may be detrimental to the motor 72 is allowed to enter it.

Figure 6:
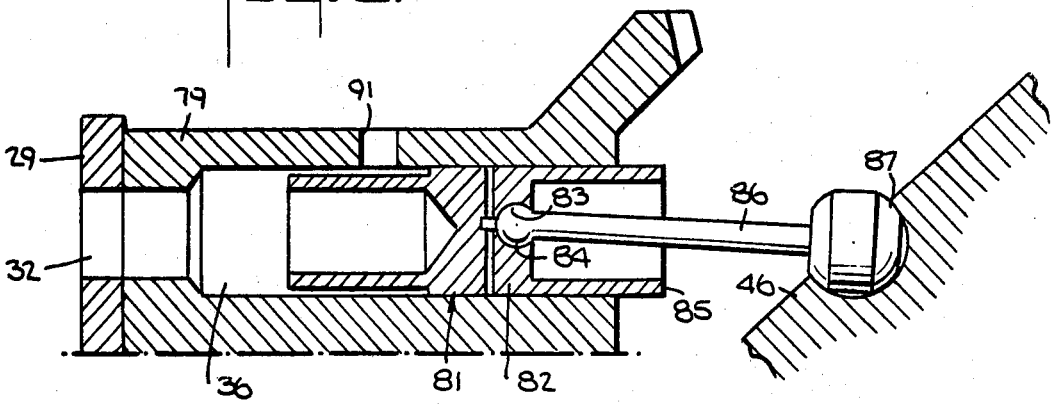
FIG. 6 is a cross-sectional fragmentary view of the motor in FIG. 2 showing a modified form of piston.

The motor 11 shown in FIG. 2 includes pistons of a generally spherical shape. This shape is similar to that of a sphere that has had slices taken off of its polar regions parallel to its equator. Such a piston requires careful machining and it is desirable to provide a more typical, cylindrical piston. Such a structure is shown in FIG. 6. In this figure, a fragment of a cylinder block 79, which may be the same as the cylinder block 34 in FIG. 2 is shown. At one end of the cylinder block 74 is the port plate 29 shown in cross-section at a point that includes the intake port 32. This intake ports leads to the cylinder 36, but the piston 81 is of a generally cylinder structure.

More specifically, the piston 81 includes a central portion 82 with a spherical receptacle 83 to receive a generally spherical small end 84 of a connecting rod 86. A generally spherical big end, which is of essentially the same structure as the small end is indicated by reference numeral 87 at the other end of the connecting rod 86, and it is this big end that fits into the swash plate 46. The cylinder 81 has one hollow spherical end 88 that extends toward the port plate 29 and has an outer surface 89 of slightly smaller diameter than the cylinder 36. The space between the surface 89 and the wall of the cylinder 36 may be of the order of 0.0013 cm., which is sufficiently small to prevent water that enters the cylinder 36 from reaching the part of the cylinder wall in which the portion 82 of the piston 81 moves back and forth. The cylinder block 79 is provided with a vent 91 in the region overlapped by the cylindrical portion 88 to allow any water that does reach that part of the cylinder wall to escape. The remainder of the piston 81, including the portion 82 and a skirt 83 have a diameter greater than the diameter of the portion 88 but, of course, smaller than the diameter of the cylinder 36. The connecting rod 86 has a central oil channel (not shown) to carry oil to an oil way 92 in the piston 81. This oil is directed outwardly against the wall of the cylinder 36 to provide a lubricating film within which the piston 81 slides, and by virtue of the cylindrical extension 88 and the vent 91, this lubricating film is not degraded by water used to power the motor.

Figure 7:
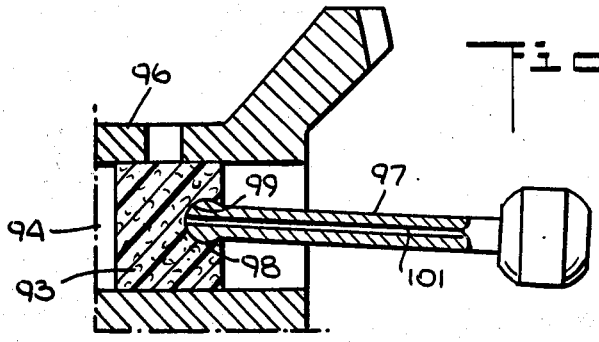
FIG. 7 is a fragmentary cross-sectional view showing a further modified form of piston in the motor in FIG. 2.

FIG. 7 shows a further modification in which a short cylindrical piston 93 rides in a cylinder 94 in a cylinder block 96. This cylinder is connected to a connecting rod 97 by engagement between a spherical nob 98 at the end of the rod 97 and a spherical recess 99 in the piston 93.

The material of which the piston 93 is made is porous to lubricating oil, but only to a limited degree. Thus oil forced up the central channel 101 of the connecting rod 97 is gradually forced out through the body of the piston 93 and provides lubrication between the piston and the wall of the cylinder 94.

As an alternative embodiment, the cylinder block 96 may be made of material that is slightly porous to oil in order to provide the lubrication between the cylinder wall and the piston.

Both the embodiments in FIGS. 6 and 7 are especially adapted to use water as the liquid to power the motor, and for this purpose, it is important that both the cylinder block 76 in FIG. 6 and the piston 81 be of material that is not corroded or attacked chemically by water. The same is true of the material of the cylinder block 96 and the piston 93 in the embodiment in FIG. 7.

Figure 8:
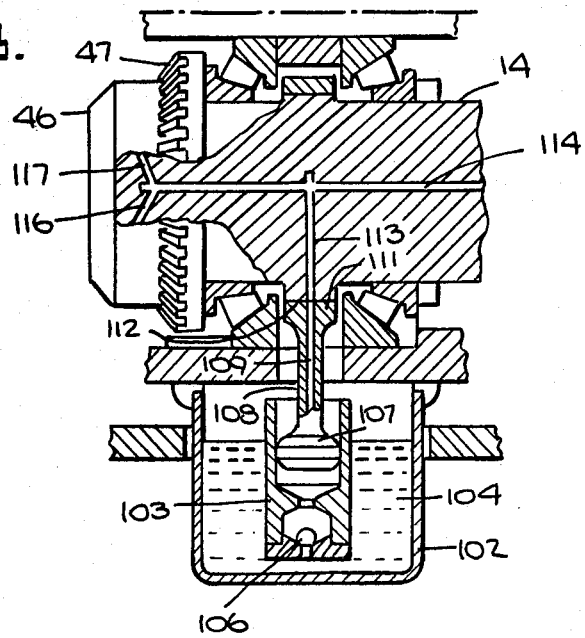
FIG. 8 is a partial cross-sectional view of an oil pump mechanism for use in connection with the motor in FIG. 2.

In order to provide sufficient oil for lubricating the structure, FIG. 8 shows a modification in which an oil sump 102 is provided. A cylinder 103 extends into the oil 104 in the sump 102 and has an opening 106 to allow oil to enter the cylinder freely. The cylinder has a piston 107 of generally spherical configuration rigidly connected to a connecting rod 108 and provided with an oil channel 109 that extends from the end of the piston 107 to the opposite end of the connecting rod 108.

The end of the connecting rod 108 opposite the piston 107 is formed as a ring 111 that fits relatively closely around a cam surface 112 formed on the shaft 14 of the motor in FIG. 2. The cam surface 112 is simply a cylinder having an axis slightly displaced from the axis of the shaft 14 so that as the shaft rotates, the piston 107 is forced to go up and down and thereby force oil into the channel 109. The shaft has a channel 113 that communicates with the channel 109 and feeds oil to an axial oil way 114 from which other oil ways 116 and 117 direct the oil to surfaces that need to be lubricated.

While this invention has been described in terms of specific embodiments, it will be understood by those skilled in the art that it may be subjected to numerous modifications which are still within the scope of the invention as defined by the following claims.

What is claimed is:

1. Spraying apparatus comprising:

a liquid-powered, positive displacement reciprocating motor for producing rotary motion, said motor having power transfer means for converting a potential energy of the pressurized liquid to a mechanical energy;

impeller means connected to said motor to be rotated thereby for generating a stream of moving air;

intake port means for receiving pressurized liquid having energy to power said motor and supplying said pressurized liquid to said power transfer means;

low-pressure liquid exit means connected to said power transfer means for receiving at least a portion of a low-pressure liquid which is expelled from said power transfer means after said energy conversion; and conduit means having an inlet means connected to receive at least a portion of the liquid received to power said motor, and a shell surrounding said power transfer means and spaced therefrom to define a generally annular channel intermediate of said power transfer means and said shell for delivering to the stream of air at least a portion of the liquid entering said intake port means, the portion of the liquid delivered to the stream of air being entrained in the stream and moved by the stream.

2. The invention as defined in claim 1 in which said low-pressure liquid exit means is connected only to said inlet means of said conduit means for supplying to said conduit means all of the low-pressure liquid expelled from said power transfer means.

3. The invention as defined in claim 1 in which said impeller means comprises a fan having:

a hub attached to said power transfer means to be rotated thereby; and a plurality of fan blades, each extending from said hub for a respective predetermined radial distance, an angular width of said fan blades being greater than an angular spacing between respective leading edges of adjacent ones of said fan blades, said annular channel of said conduit means having an annular exit between said fan, an inner radius of said annular channel at said annular exit being arranged at a radial distance at least substantially as great as an outer radius of said hub and substantially less than said respective predetermined radial distance of each of said fan blades.

4. The invention as defined in claim 3 further comprising:

guard means attached to said motor, said guard means having:

hand-hold means for facilitating carrying of the spraying apparatus;

a duct arranged to be coaxial with said hub of said fan and surrounding the outermost tips of said fan blades, said duct cooperating with said fan blades in defining the configuration of the stream of moving air; and grill means for preventing inadvertent contact with said fan blades while permitting substantially free passage of air through said fan.

5. The invention as defined in claim 4 in which said grill means comprises a plurality of metal straps extending substantially radially outwardly from a center coaxial with said hub of said fan and, on the other side of said fan from said motor, said straps being wider in the axial direction of said hub of said fan than in the circumferential direction thereof and being curved at their radially outer ends in the direction opposite the direction of rotation of said fan blades, the outermost ends of said straps being connected to said duct.

6. The invention as defined in claim 1 in which said motor is of the type having a shaft, said impeller means being a fan connected to said shaft to rotate therewith, said fan further comprising:

a hub; and a plurality of blades spaced apart around the hub by uniform angular distances, the width of each of said blades in the angular direction being greater than the angular spacing between the leading edges of adjacent ones of said blades over a substantial portion of the radial extent of respective ones of said blades.

7. The invention as defined in claim 6 in which said plurality of blades is divided into first and second sets of blades, said first set of blades being equally angularly spaced apart around said hub, and said second set of blades having an equal number of said blades as said first set of blades, each of said blades of said second set of blades being spaced between a respective pair of said blades of said first set of blades, the tips of each of said blades in said second set of blades extending radially outwardly from said hub for a lesser distance than the tips of said blades of said first set of blades.

8. The invention as defined in claim 7 in which the thickness of each of said blades increases towards a trailing edge thereof relative to the thickness of the respective blade toward a central region thereof.

9. The invention as defined in claim 7 in which the tips of said blades of said first set of blades follow a circular path having a diameter between about 45–60 centimeters, and said blades of said second set of blades follow a circular path having a diameter which is approximately 5–6 centimeters less than said blades of said first set of blades of said fan.

10. The invention as defined in claim 6 in which said stream of air from the fan moves more than 800 cubic meters of air per minute.

11. The invention as defined in claim 1 further comprising:

low pressure liquid exit means connected to said motor for receiving low pressure liquid that has been used to power said motor; and valve means connected to said low pressure liquid exit means, said inlet means being connected to said low pressure liquid exit means via said valve means.

12. The invention as defined in claim 11 in which said valve means is adjustable to direct a selected portion of the low pressure liquid to said low pressure liquid exit means and the remainder to said inlet means.

13. The invention as defined in claim 1 comprising valve means connected to said intake port means, said motor, and said inlet means for directing to said conduit means, via said inlet means thereof, part of the pressurized liquid received at said intake port means.

14. The invention as defined in claim 13 in which said valve means is adjustable to control the proportion of the pressurized liquid which is directed to said motor relative to the proportion of the pressurized liquid which is directed to said conduit means.

15. The invention as defined in claim 14 in which said conduit means further comprises a discharge end located downstream of said impeller means and within the air stream from said impeller means to discharge a stream of the pressurized liquid into the air stream.

16. The invention as defined in claim 14 in which said conduit means comprises a discharge end located between said impeller means and said motor.

17. The invention as defined in claim 1 further comprising additional inlet means connected to said conduit means for supplying selectable chemicals to the spraying apparatus other than the liquid received to power said motor.

18. The invention as defined in claim 1 in which said motor comprises a positive-displacement water-powered actuator comprising:

a swash plate;

a cylinder block having a water inlet, a water outlet, and a cylinder having a cylinder wall;

a cylindrical piston having a first cylindrical portion facing said water inlet and said water outlet, said first cylindrical portion having a diameter sufficiently small to engage within said cylinder and sufficiently large to prevent any substantial quantity of water from passing between said first cylindrical portion and said cylinder wall, and a second cylindrical portion facing away from said water inlet and having a diameter larger than said first cylindrical portion and smaller than said cylinder.

19. The invention as defined in claim 18 wherein there is provided a vent extending through said cylinder wall in a region thereof overlapped by said first cylindrical portion to vent any water entering that region.

20. The invention as defined in claim 1 in which said motor is a positive-displacement water-powered actuator comprising:

a swash plate;

a cylinder block constructed of a first material resistant to water corrosion and having a cylinder;

a cylindrical piston constructed of a second material resistant to water corrosion and slidably movable in said cylinder; and a connecting rod having spherical end portions for connecting to said cylindrical piston and said swash plate said connecting rod having an oil channel extending longitudinally therethrough for conducting lubricating oil to said piston.

21. The invention as defined in claim 20 in which said first material is slightly porous to oil.

22. The invention as defined in claim 20 in which the second material is slightly porous to oil.

23. The invention as defined in claim 20 further comprising:

a shaft concentric with said swash plate;

an oil channel arranged in said shaft;

an eccentric cam on said shaft;

an oil sump;

an oil supply cylinder open to said oil sump;

an oil supply piston arranged to be slidably movable in said oil supply cylinder; and an oil-feed connecting rod for connecting said oil supply piston to said eccentric cam to be reciprocated in said oil supply cylinder by said eccentric cam, said oil-feed rod having an oil channel therethrough for communicating with said oil sump to allow oil to be forced through said oil channel in said shaft to lubricate said motor.

24. A method of producing a stream of liquid particles entrained in a stream of air, the method comprising the steps of:

receiving at an intake port a pressurized liquid;

actuating a positive displacement, liquid driven motor by a stream of said pressurized liquid received at said intake port to cause said motor to drive an impeller to produce the stream of air;

directing a part of said pressurized liquid received at said intake port to an input portion of a shell surrounding at least a portion of said motor, said shell having an output portion configured as an annular channel; and directing said part of said pressurized liquid released by said output portion of said annular channel of said shell substantially concentrically with said impeller and into the stream of air to be entrained thereby as finely divided particles of said liquid.

25. The method of claim 24 in which said part of said pressurized liquid directed into the stream of air is separated from said stream of pressurized liquid, the remainder of said liquid in said stream of pressurized liquid being directed to operate said motor.

26. The method of claim 24 in which said part of said liquid directed into the stream of air enters the stream of air at a region between said motor and said impeller.

27. The method of claim 24 in which said part of said liquid directed into the stream of air enters the stream of air on a downstream side of said impeller.

28. The method of claim 24 in which said part of said liquid directed into the stream of air is liquid that has passed through said motor to transfer power thereto.

29. A method of fighting a fire in a building, the method comprising the steps of:

actuating a liquid-driven motor by a stream of pressurized liquid to cause said motor to drive an impeller to produce a stream of air;

directing at least part of said liquid into said stream of air to be entrained thereby as an aerosol of finely divided particles of said liquid, said part of said liquid being directed as an annular stream toward said impeller, said annular stream being substantially concentric with said impeller; and directing said aerosol into a region of the building, in which the fire is located, to increase the pressure in a predetermined part of the building by means of the aerosol to force combustion products of the fire in a selected direction.

* * * * *